US010654157B2

(12) United States Patent
Jones

(10) Patent No.: US 10,654,157 B2
(45) **Date of Patent: *May 19, 2020**

(54) SELF-CONTAINED FORCE MAGNIFYING CHISEL

(71) Applicant: Jared Scott Jones, Salt Lake City, UT (US)

(72) Inventor: Jared Scott Jones, Salt Lake City, UT (US)

( * ) Notice: Subject to any disclaimer, the term of this patent is extended or adjusted under 35 U.S.C. 154(b) by 75 days.

This patent is subject to a terminal disclaimer.

(21) Appl. No.: 15/960,430

(22) Filed: Apr. 23, 2018

(65) Prior Publication Data

US 2018/0236648 A1 Aug. 23, 2018

Related U.S. Application Data

(63) Continuation-in-part of application No. 14/939,041, filed on Nov. 12, 2015, now Pat. No. 9,975,231.

(60) Provisional application No. 62/088,026, filed on Dec. 5, 2014.

(51) Int. Cl.

| | |
|---|---|
| ***B25D 3/00*** | (2006.01) |
| ***B25D 1/00*** | (2006.01) |
| ***B25D 5/00*** | (2006.01) |
| ***B25D 1/16*** | (2006.01) |
| *B25B 27/04* | (2006.01) |

(52) U.S. Cl.

CPC ..... *B25D 3/00* (2013.01); *B25D 1/00* (2013.01); *B25D 1/16* (2013.01); *B25D 5/00* (2013.01); *B25B 27/04* (2013.01); *B25D 2222/42* (2013.01); *B25D 2250/111* (2013.01); *B25D 2250/141* (2013.01); *B25D 2250/241* (2013.01); *B25D 2250/361* (2013.01); *B25D 2250/371* (2013.01)

(58) Field of Classification Search

CPC .. B25B 27/04; B25D 1/10; B25D 1/16; B25D 2250/111; B25D 2250/241; B25D 2250/371; B25D 3/00; B25D 5/00

USPC ..... 30/167

See application file for complete search history.

(56) References Cited

U.S. PATENT DOCUMENTS

| | | | | |
|---|---|---|---|---|
| 783,749 | A * | 2/1905 | Hartley et al. | |
| 789,520 | A * | 5/1905 | Adell et al. | |
| 833,712 | A * | 10/1906 | Geisenhoner | |
| 889,409 | A * | 6/1908 | Spalding | |
| 1,229,732 | A * | 6/1917 | Erickson | B23D 29/005 30/277 |
| 1,259,335 | A * | 3/1918 | Acton | B25D 5/00 33/671 |
| 1,572,046 | A * | 2/1926 | Seiler | B25D 5/02 30/367 |

(Continued)

*Primary Examiner* — Hwei-Siu C Payer

(74) *Attorney, Agent, or Firm* — Travis R. Banta; TechLaw Ventures, PLLC

(57) ABSTRACT

The self-contained force magnifying tool disclosed herein includes a tool portion, a striker, at least a portion of which is disposed within the tool portion, and a spring, a least a portion of which is disposed within the tool portion. The spring attaches to both the tool portion and the striker. When the striker is pulled by a user, the spring stores mechanical energy. When the user releases the striker, the striker impacts on the tool portion transferring the mechanical energy stored in the spring into a driving force. The force is magnified by a tool disposed on the tool portion of the self-contained force magnifying hand tool and applied to a workpiece.

20 Claims, 5 Drawing Sheets

(56) References Cited

U.S. PATENT DOCUMENTS

| | | | | | |
|---|---|---|---|---|---|
| 1,665,109 | A * | 4/1928 | Nelson | B25D 3/00 | 30/277 |
| 2,135,404 | A * | 11/1938 | Lofstrand, Sr. | B02C 19/0087 | 241/99 |
| 2,446,848 | A * | 8/1948 | Prester | B25D 5/00 | 30/367 |
| 2,485,877 | A * | 10/1949 | Hamilton, Jr. | A01G 3/06 | 30/277 |
| 2,675,079 | A * | 4/1954 | Hughes | C14B 5/00 | 30/367 |
| 2,787,178 | A * | 4/1957 | Maxim | B25D 5/02 | 173/203 |
| 3,029,512 | A * | 4/1962 | Saxton | B25D 5/02 | 30/367 |
| 3,036,482 | A * | 5/1962 | Kenworthy | B25C 1/02 | 173/90 |
| 4,458,415 | A * | 7/1984 | Maher | B25B 27/02 | 144/195.5 |
| 4,829,673 | A * | 5/1989 | Hicks | B25D 3/00 | 30/167 |
| 6,684,514 | B2 * | 2/2004 | Welch | B23B 47/287 | 30/366 |
| 8,141,255 | B2 * | 3/2012 | Su | B25D 3/00 | 173/90 |
| 9,592,797 | B2 * | 3/2017 | Jackson | B60S 3/045 | |
| 9,975,231 | B2 * | 5/2018 | Jones | B25D 3/00 | |
| 2016/0158928 | A1 * | 6/2016 | Jones | B25D 3/00 | 30/167 |
| 2018/0236648 | A1 * | 8/2018 | Jones | B25D 3/00 | |

* cited by examiner

SELF-CONTAINED FORCE MAGNIFYING CHISEL

PRIORITY CLAIM

This application is a continuation-in-part of U.S. patent application Ser. No. 14/939,041, filed on Nov. 12, 2015, now U.S. Pat. No. 9,975,231, which, in turn, claims priority to U.S. Provisional Application No. 62/088,026, filed on Dec. 5, 2014. These applications are incorporated by reference in their entirety.

BACKGROUND

1. Technical Field

An apparatus disclosed herein generally relates to hand tools. More specifically, the apparatus disclosed herein relates to tools which are intended to be used in applications where striking an object is necessary for a particular operation. For example, hand tools such as hammers, nail sets, punches (e.g., center punches, roll pin punches, etc.), awls, handheld chisels and any other suitable tool.

2. Description of the Related Art

Hand tools have many different applications for performing various tasks that may be difficult to perform with a bare hand or other device. For example, hammers have been developed using steel in a particular shape that is designed specifically for driving nails on one end and removing nails on another end. While other objects, such as rocks, could drive a nail, rocks are not designed to drive nails and are less useful than a hammer at the job of pounding nails. Many hand tools require a user to strike a workpiece to manipulate the workpiece into its intended function. For example, a roll punch may be specifically adapted to punch a roll pin into a firearm while a hammer may be designed to strike nails into building materials. Another example may be a chisel. Chisels are hand tools with a sharpened, or bladed, end for cutting, carving, or breaking stone, metal, and wood and a non-sharpened end. Conventional chisels require the use of a mallet or a hammer to strike a non-sharpened end of the chisel in order to drive the chisel into a workpiece. A workpiece may therefore be cut, shaped, carved, broken, or cleaned by positioning the chisel on the work piece and hitting the chisel with a mallet or a hammer.

Conventional hand tools intended to impact or strike a workpiece have several drawbacks. First, as discussed above, users of conventional striking hand tools hold a conventional hand tool in one hand and strike the hand tool with another hand tool, such as a hammer or mallet using another hand. Even skilled users, however, can miss the hand tool with the hammer or mallet and land a striking blow on the hand that is holding the hand tool, causing injury to the hand holding the hand tool. This problem is only exacerbated when the hand tool is held by one person and the hammer blows are delivered by a second person. At least one object of at least one apparatus disclosed herein is to provide a hand tool that prevents injury to a user of a hand tool.

Second, conventional striking hand tools cannot be fully operated without an additional tool, namely, a hammer or mallet. The mechanical advantage of a hand tool is provided in focusing the force of a striking blow into a the hand tool. However, that mechanical advantage cannot be obtained without some additional tool to provide a striking blow to the hand tool. Thus, at least one problem with conventional hand tools is that conventional hand tools require the use of two tools for proper operation. It is one object of at least one apparatus disclosed herein to provide a self-contained hand tool, which includes a striker, and thus eliminates the need for two separate tools to operate a striking hand tool.

Third, conventional striking hand tools are made to suit one particular purpose. Thus, a user must acquire multiple striking hand tools that are suitable for each different purpose. For example, a carpenter's chisel has a sharpened end for cutting wood while a welding chisel may be sharpened to a wide flat blade suitable for scraping scale from a weld. The sharpened end of the carpenter's chisel would be ruined by scraping the scale off a weld. Likewise, the wide flat blade on the welding chisel is not sharp enough to cut wood. While these are merely examples of two kinds of chisels, and there are hundreds or possibly even thousands of different kinds of striking hand tools, it is apparent that different chisels are suitable for a particular purpose. It is one object of at least one apparatus described herein to provide a striking hand tool with removable bits that allow a user to change the bit or blade on the chisel without requiring an entirely different hand tool.

SUMMARY

Consistent with embodiments disclosed herein, a tool is disclosed. The tool includes a tool portion including impact shoulders which are disposed within the tool portion. The tool also includes a striker, at least a portion of which is disposed within the tool portion. The tool further includes a spring, at least a portion of which is disposed within the tool portion and at least a portion of which is disposed within the striker, and which is attached to the tool portion and the striker. The striker, being disposed within the tool portion, impacts the tool portion on the impact shoulders disposed within the tool portion.

In another implementation, method of making a tool is disclosed. The method comprises disposing a spring within a tool portion of the tool, the tool portion of the tool including impact shoulders disposed within the tool portion of the tool. The method further comprises attaching the spring to the tool portion of the tool within the tool portion. The method also comprises disposing, within the tool portion of the tool, a striker, the spring being disposed within the striker and attaching to the striker within the striker, the striker being disposed in the tool portion of the tool to impact the tool portion on the impact shoulders disposed within the tool portion of the tool.

Also disclosed herein is a tool kit. The tool kit includes a tool portion including impact shoulders which are disposed within the tool portion. The tool kit also includes a striker, at least a portion of which is disposed within the tool portion. The tool kit further includes a spring, at least a portion of which is disposed within the tool portion and at least a portion of which is disposed within the striker, and which is attached to the tool portion and the striker. The striker, being disposed within the tool portion, impacts the tool portion on the impact shoulders disposed within the tool portion. The tool kit also includes one or more tool bits.

BRIEF DESCRIPTION OF THE DRAWINGS

The accompanying drawings illustrate several embodiments of the self-contained force magnifying hand tool disclosed herein and constitute a part of the specification. The illustrated embodiments exemplary and do not limit the scope of the disclosure.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figures 1A, 1B, 1C:
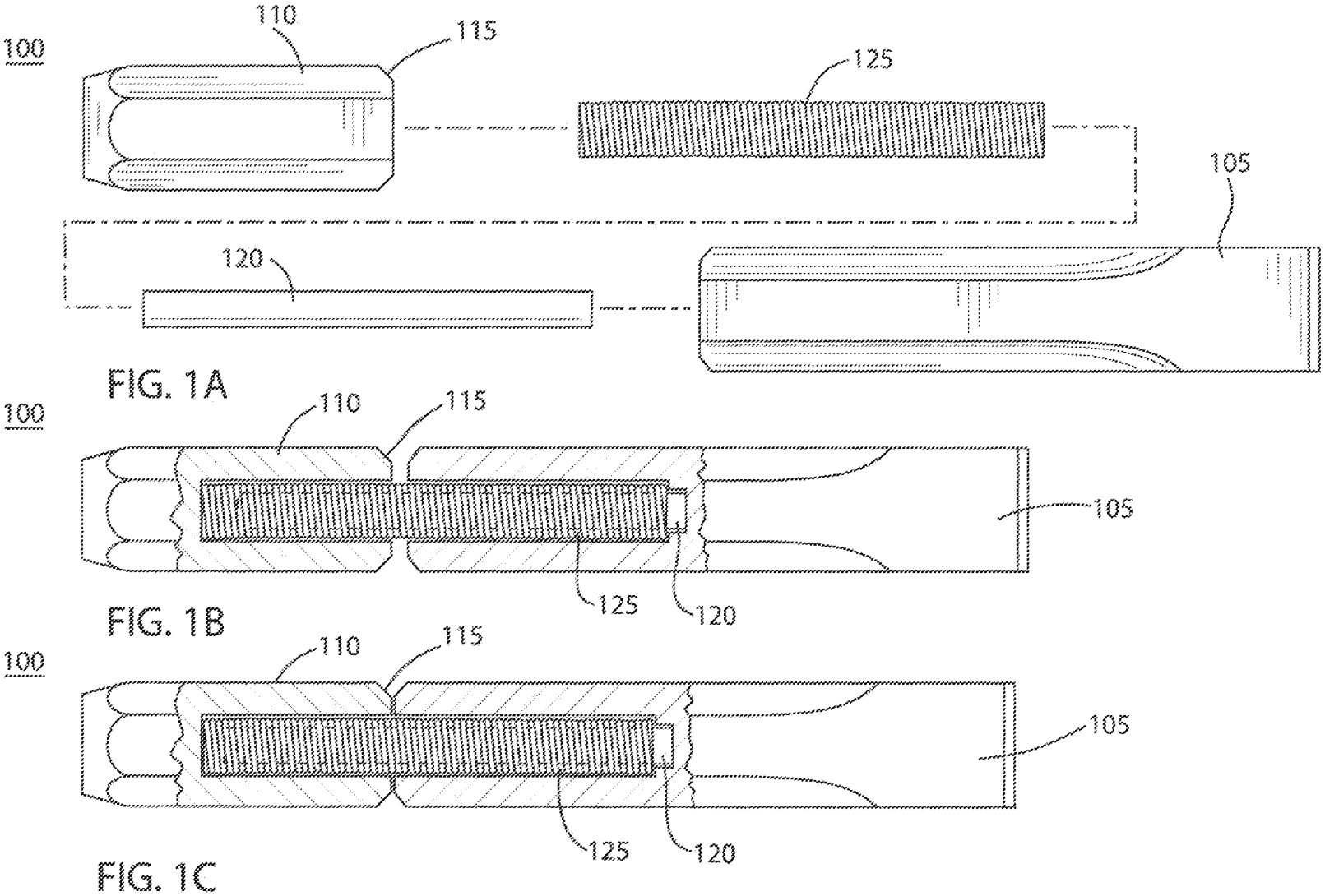
FIG. 1A illustrates an exploded view of the self-contained force magnifying hand tool disclosed herein.
FIG. 1B illustrates a cross-sectional side view of the self-contained force magnifying hand tool disclosed herein during extension.
FIG. 1C illustrates a cross-sectional side view of the self-contained force magnifying hand tool disclosed herein during compression.

FIG. 1A is an exploded view of the self-contained force magnifying hand tool 100 disclosed herein. Self-contained force magnifying hand tool 100 includes tool portion 105, striker portion 110, spring guide tube 120, and spring 125. As shown in FIG. 1A, spring guide tube 120 is inserted into spring 125. Spring 125 is attached on one end to tool portion 105 of self-contained force magnifying hand tool 100 and on the opposite end to striker portion 110 of self-contained force magnifying hand tool 100. Thus, self-contained force magnifying hand tool 100 is self-contained because it contains a both a striker and a tool in one tool, obviating the need for two tools to operate, in this example, a chisel. Further, self-contained force magnifying hand tool 100 magnifies the force applied by the striker portion 110 impacting the tool portion 105 by reducing the surface area to which the force is applied through an exemplary chisel blade on tool portion 105. Thus, the force applied by self-contained force magnifying hand tool 100 to a workpiece is magnified to exert substantially the same force applied to the relatively large surface area on tool portion 105 struck by striker portion 110 into a smaller surface area on the workpiece by the exemplary chisel blade. However, it is to be noted that although self-contained force magnifying hand tool 100 is shown as a chisel in FIGS. 1A, 1B, and 1C, self-contained force magnifying hand tool 100 may be shaped into any other striking tool, such as those disclosed herein and others known in the art.

In one embodiment, tool portion 105 and striker portion 110 may be machined from cold-rolled steel, tool steel, carbon steel, or stainless steel. However, any metal or metal alloy with hardness properties that are sufficient to be uninterrupted by multiple strikes into the same or any other similarly hard metal or metal alloy would be suitable for use in tool portion 105 and striker portion 110. For example, metal hardness is generally identified using the Brinell Scale and a Brinell hardness number. In one embodiment, metals and metal alloys suitable for use in tool portion 105 and striker portion 110 are rated over 500 HB on the Brinell Scale or correspondingly on other scales. Further, metals and metal alloys that are dense, i.e., have a high mass to volume ratio, such as steel, are preferred for use in striker portion 110 and tool portion 105 over metals that are less dense, such as aluminum.

In another embodiment, tool portion 105 includes a chisel blade, as shown in FIG. 1A, although any striking hand tool may be implemented in place of the chisel blade. The chisel blade, or other striking too, may be machined into tool portion 105 and shaped to provide a particular end on self-contained force magnifying hand tool 100. Any known chisel blade or point may be implemented on tool portion 105.

In another embodiment, spring 125 may be a coil spring made from spring steel. While in FIG. 1A, spring 125 is shown as a coil spring, this is merely representative of any type of spring that may be attached to tool portion 105 and striker portion 110 of self-contained force magnifying hand tool 100. Further, any material, metal, metal alloy, composite, or plastic with elastic properties may be used to fashion spring 125. Any spring that is able to contain sufficient mechanical energy to pull striker portion 110 into tool portion 105 may be used as spring 125. Ideally, the mechanical energy contained within spring 125 is matched to the intended driving force of self-contained force magnifying hand tool 100 and is less than the bending or breaking strength of spring 125.

In another embodiment, spring guide tube 120 may be made of any metal, metal alloy, composite, or plastic. Ideally spring guide tube 120 is in substantially frictionless contact with spring 125 such that spring 125 is free to extend and compress around spring guide tube 120. It is noted that spring guide tube 120 is shown in FIG. 1A such that spring 125 is positioned around spring guide tube 120. However, while not shown, spring 125 may also be disposed within spring guide tube 120. Spring guide tube 120 is further configured such that a length of spring guide tube 120 does not prevent striker portion 110 from impacting on tool portion 105. In other words, the length of spring guide tube is long enough to guide spring 125 during extension of the spring but not long enough to prevent striker portion 110 from striking tool portion 105 when mechanical energy stored by spring 125 is released.

When spring 125 is attached to both tool portion 105 and striker portion 110, the spring is substantially fully compressed. In one embodiment, spring 125 may be configured to provide just enough compression force that spring 125 pulls tool portion 105 and striker portion 110 together such that both tool portion 105 and striker portion 110 butt up against each other at bevel 115.

In operation, self-contained force magnifying hand tool 100 is configured to provide an operative chisel in a single tool. For example, a user may hold tool portion 105 in one hand while the user holds striker portion 110 in another hand. The user may then apply an extension force to spring 125 such that striker portion 110 is pulled away from tool portion 105. Mechanical energy is stored in spring 125 which is attached to both striker portion 110 and tool portion 105 using techniques which will be described below. The mechanical energy stored in spring 125 is released when the user releases striker portion 110. The compression force of spring 125 pulls striker portion 110 into tool portion 105. The force of striker portion 110 impacting tool portion 105 applies a force to tool portion 105 which is then applied to a workpiece. In other words, a driving force is applied to tool portion 105, which is then magnified into a particular area on a workpiece by a tool end on tool portion 105. Bevel 115 protects the chisel user's hand from pinching as striker portion 110 impacts tool portion 105.

FIG. 1B illustrates a cross-sectional side view of the self-contained force magnifying hand tool 100 during extension of spring 125. As shown in FIG. 1B, tool portion 105 and striker portion 110, to which spring 125 are attached, may be pulled apart by a user exerting an extension force on spring 125. Spring guide tube 120 is shown as disposed inside spring 125, although in some embodiments, spring 125 may be disposed inside spring guide tube 120. As striker portion 110 is separated from tool portion 105, spring 125 extends, loading spring 125 with mechanical energy that tries to return spring 125 to a compressed state. Bevel 115 prevents the tool portion 105 and striker portion 110 from pinching the user's fingers when striker portion 110 is released by the user.

FIG. 1C illustrates a cross-sectional side view of self-contained force magnifying hand tool 100 during compression of spring 125. As discussed above, FIG. 1B shows self-contained force magnifying hand tool 100 during extension of spring 125. FIG. 1C, therefore, shows self-contained force magnifying hand tool 100 after the user has released the mechanical energy contained in spring 125, discussed above, by releasing striker portion 110 to impact on tool portion 105 of self-contained force magnifying hand tool 100. When striker portion 110 is released, spring guide tube 120, whether internal or external to spring 125, guides spring 125 back into a compressed state. The mechanical energy released by the spring drives striker portion 110 into tool portion 105, creating a driving force for tool portion 105. That force is magnified by a tool end on tool portion 105 and applied to a workpiece. Bevel 115 prevents a user's hands from being pinched as striker portion 110 is released.

Figure 2A:
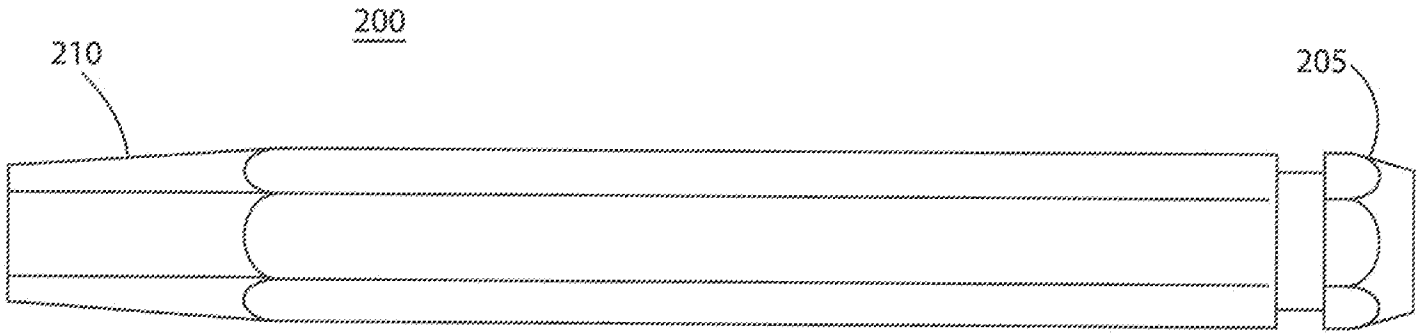
FIG. 2A illustrates a side view of the self-contained force magnifying hand tool disclosed herein with an internal striker.

FIG. 2A illustrates a side view of self-contained force magnifying hand tool 200 with an internal striker 205. Self-contained force magnifying hand tool 200 includes a tool portion 210 which is machined such that an inside diameter of tool portion 210 is greater than an outside diameter of at least a portion of internal striker 205. In other words, internal striker 205, shown in FIG. 2A, includes both a male end that may be disposed inside a female end of tool portion 210 and a handle which may be grasped by a user.

Figure 2B:
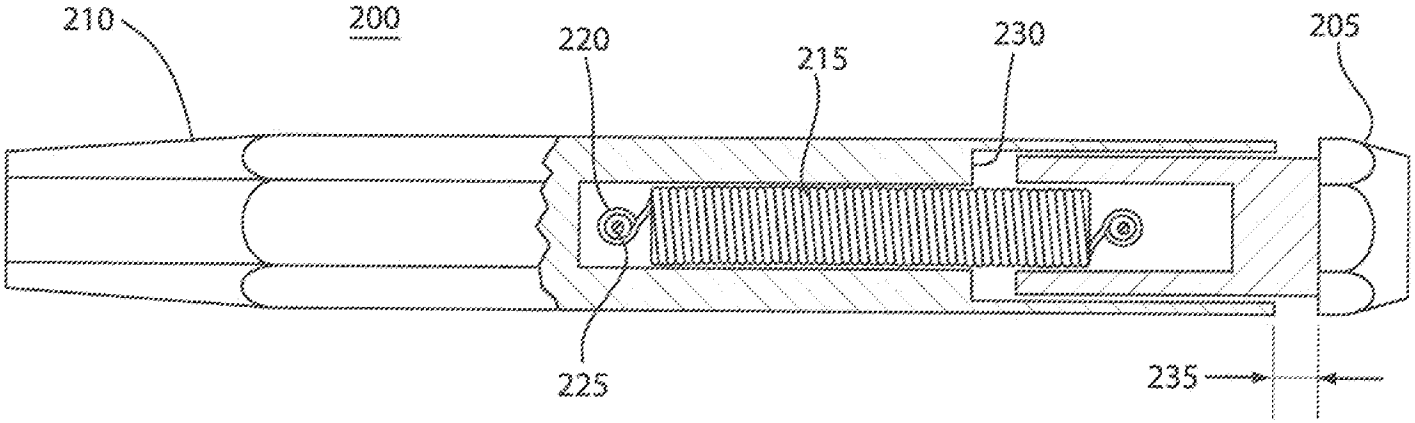
FIG. 2B illustrates a cross sectional side view of the self-contained force magnifying hand tool shown in FIG. 2A.

FIG. 2B illustrates a cross sectional side view of self-contained force magnifying hand tool 200 shown in FIG. 2A. As discussed above, a male end of internal striker 205 is disposed within tool portion 210 and includes a handle that may be grasped by a user. Also disposed within tool portion 210 of self-contained force magnifying hand tool 200 is spring 215, which is attached to both tool portion 210 and internal striker 205. FIG. 2B does not show a spring guide tube. However, a spring guide tube, such as spring guide tube 120 discussed with respect to FIG. 1A may be included in some embodiments. Rather, in FIG. 2B, tool portion 210 has been machined such that spring 215 may be disposed within tool portion 210. Thus, the internal portion of tool portion 210 may act as a spring guide tube, guiding spring 215 as it is extended and compressed. Spring 215 may be configured such that one or more spring coils 220 on each end of spring 215 are bent to be substantially perpendicular to the rest of spring 215. The term substantially perpendicular means that one or more spring coils 220 are bent such that a spring retainer 225 may be disposed in tool portion 210 and through one or more spring coils 220 of spring 215. Spring 215 may therefore be attached to tool portion 210 by spring retainer 225.

Spring retainer 225 may include a pin, a tapered pin, a screw, a bolt, a rivet, a rod, or any other similar device. In one embodiment, a pin, acting as spring retainer 225 may be inserted through a hole, corresponding in size to the pin, in tool portion 210 through one or more spring coils 220, and into another hole in tool portion 210. Thus, the pin is supported on two sides by holes in tool portion 210 and travels through one or more spring coils 220 in order to attach spring 215 to tool portion 210.

A second spring retainer 225 may be installed in internal striker 205 to attach spring 215 to internal striker 205 in the same manner that spring retainer 225 is installed on tool portion 210. For example, spring 215 may have one or more spring coils 220 bent such that one or more spring coils 220 are substantially perpendicular to spring 215. The term substantially perpendicular means that one or more spring coils 220 are bent such that spring retainer 225 may be disposed in internal striker 205 and through one or more spring coils 220 of spring 215. Spring 215 may also be disposed within internal striker 205. Further, a second spring retainer 225 may be inserted through holes in internal striker 205 and through one or more spring coils 220. Thus, spring 215 is attached to both tool portion 210 and internal striker 205.

Once spring 215 is attached to both tool portion 210 and internal striker 205, spring 215 pulls tool portion 210 and internal striker 205 together. In order to create an impact point between internal striker 205 and tool portion 210, tool portion 210 further includes impact shoulders 230. Impact shoulders 230 receive blows from internal striker 205 when spring 215 is extended and released. Thus, as shown in FIG. 2B, the inside of tool portion 210 is configured such that spring 215 may be disposed within tool portion 210 and, in some embodiments, act as a guide for spring 215, while also providing impact shoulders 230 that are struck by internal striker 205. FIG. 2B shows spring 215 in a slightly extended state. When spring 215 is in a compressed state, internal striker 205 rests on impact shoulders 230 within tool portion 210.

In operation, a user pulls on internal striker 205 with one hand while holding tool portion 210 in another hand, extending spring 215. The extension of spring 215, which is retained by a spring retainer 225 in both tool portion 210 and internal striker 205, creates mechanical energy in spring 215. When the user releases internal striker 205, the mechanical energy in spring 215 is released, driving internal striker 205 into impact shoulders 230 of tool portion 210. The driving force created when internal striker 205 impacts shoulders 230 of tool portion 210 is magnified by a chisel blade on tool portion 210 of self-contained force magnifying hand tool 200. In order to prevent pinching of the user's hands, gap 235 is created between the handle of internal striker 205 and tool portion 210. The length of the male end of internal striker 205 may be adjusted such that the handle of internal striker 205 does not impact tool portion 210. Rather, the impact of the internal striker 205 is applied only to tool portion 210 through impact shoulders 230. The length of the male end of internal striker 205 is configured to prevent internal striker 205 from being removed from the female end of tool portion 210 during extension of spring 215.

Figure 3A:
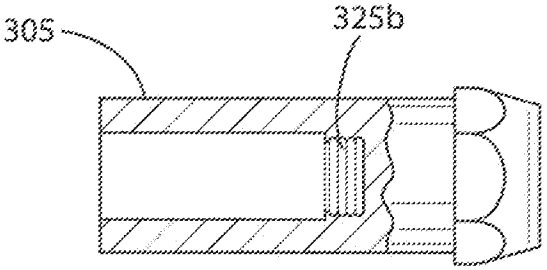
FIG. 3A illustrates a cross sectional side view of an internal striker of the self-contained force magnifying hand tool disclosed herein.

FIG. 3A illustrates a cross sectional side view of internal striker 305 of self-contained force magnifying hand tool 300, which will be discussed below. In FIG. 3A, internal striker 305 contains spring retainer 325*b* inside internal striker 305. Spring retainer 325*b* is configured to allow a spring, such as spring 320, which will be discussed below, to thread into internal striker 305.

Figure 3B:
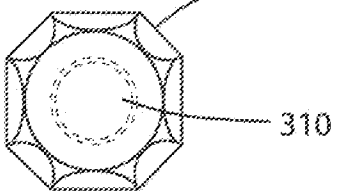
FIG. 3B illustrates a rear view of an internal striker of the self-contained force magnifying hand tool disclosed herein.

FIG. 3B illustrates a rear view of internal striker 305 of self-contained force magnifying hand tool 300, which will be described below. Internal striker 305 may be beveled on the handle end, as shown in FIG. 3B in order to give the user a better grip on internal striker 305. Both the beveling in the handle and tool portion 315, which will be discussed below, may be tooled, texturized, checkered, hammered, or subjected to any other technique that improves grip. Surface 310 of internal striker 305 may be rounded or flat.

Figure 3C:
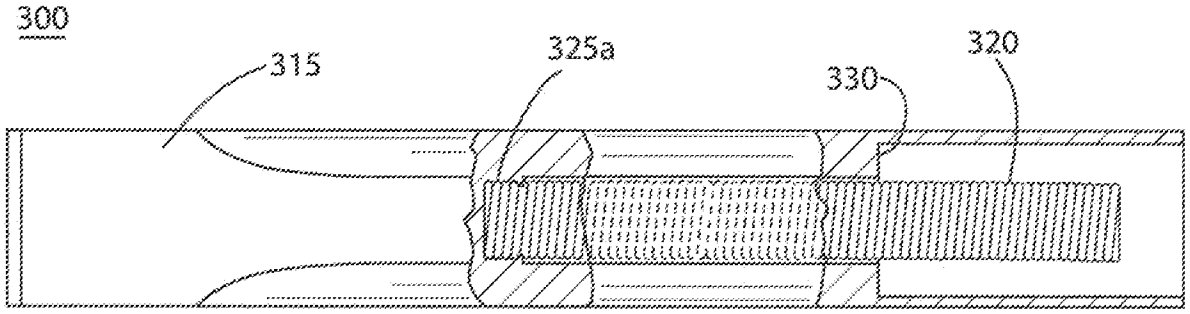
FIG. 3C illustrates a cross sectional side view of a tool portion of the self-contained force magnifying hand tool disclosed herein.

FIG. 3C illustrates a cross sectional side view of tool portion 315 of self-contained force magnifying hand tool 300. Spring 320 is disposed inside tool portion 315 as discussed above with respect to FIG. 2B. However, in FIG. 3C, spring 320 is attached to tool portion 315 of self-contained force magnifying hand tool 300 with spring retainer 325*a*. In this embodiment, spring retainer 325*a* comprises threads. The size and pitch of the threads in spring retainer 325*a* are set such that the coils of spring 320 may thread into the threads in spring retainer 325*a*, much like a bolt threads into a nut. Once spring 320 is threaded into the threads in spring retainer 325*a*, spring 320 is retained in tool portion 315. Impact shoulders 330 shown in FIG. 3C are similar to impact shoulders 230 in FIG. 2B and are used in the same way. FIG. 3C also illustrates tool portion 315 as being a chisel for exemplary purposes. However, tool portion 315 may include any striking tool known in the art.

Figure 3D:
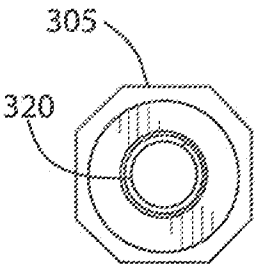
FIG. 3D illustrates front view of an internal striker of the self-contained force magnifying hand tool disclosed herein.

FIG. 3D illustrates front view of internal striker 305 of self-contained force magnifying hand tool 300. As shown in FIG. 3D, spring 320 has been threaded into threads in spring retainer 325*b*, shown in FIG. 3A, and is retained inside internal striker 305.

Figure 3E:
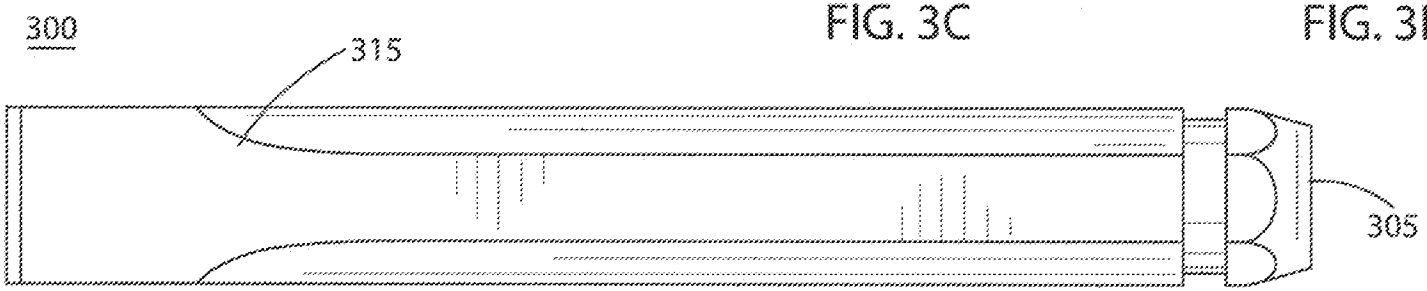
FIG. 3E illustrates a side view of the self-contained force magnifying hand tool in which the internal striker and the tool portion are assembled according to one embodiment of the self-contained force magnifying chisel.

FIG. 3E illustrates a side view of the self-contained force magnifying hand tool 300 in which internal striker 305 and the tool portion 315 are assembled according to one embodiment of self-contained force magnifying hand tool 300. In FIG. 3E, spring 320 has been installed into threads of spring retainer 325*a* in tool portion 315 and spring retainer 325*b* within internal striker 305 as shown in FIGS. 3A and 3C. Because spring 320 of FIG. 3C is retained by spring retainers 325*a* and 325*b* of FIGS. 3A and 3C within tool portion 315 and internal striker 305, respectively, an extension force can be applied to spring 320 by a user. As a user pulls on internal striker 305 with one hand and holds tool portion 315 with another hand, spring 320 is extended and stores mechanical energy. When internal striker 305 is released by the user, spring 320 returns to a compressed state, transferring the mechanical energy stored in spring 320 into a driving force when internal striker 305 impacts impact shoulders 330 within tool portion 315. The driving force is magnified by an exemplary chisel blade on tool portion 315 and applied to a workpiece.

Figure 4A:
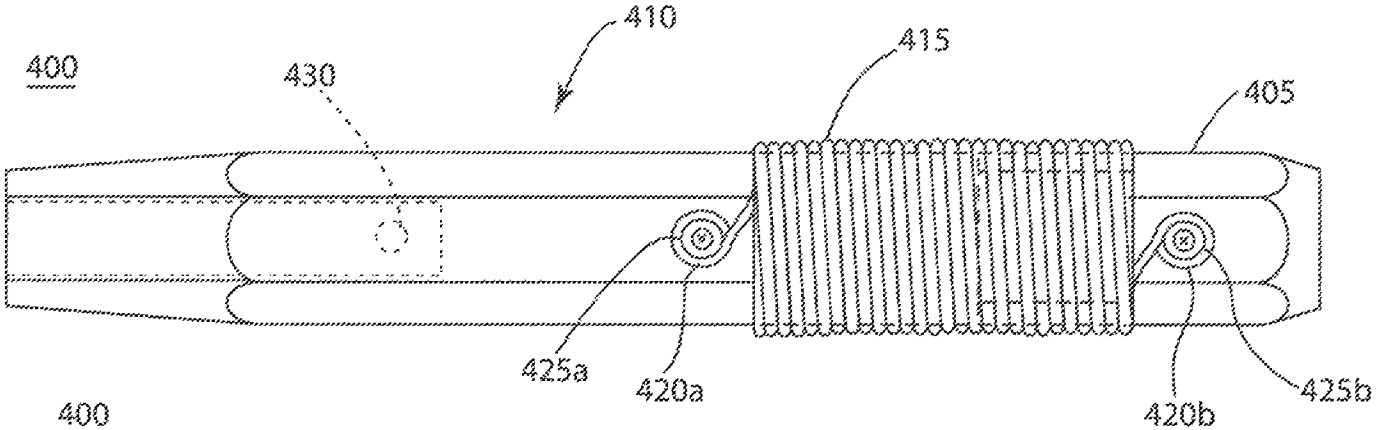
FIG. 4A illustrates another exemplary implementation of the self-contained force magnifying hand tool.

FIG. 4A illustrates an exemplary implementation of self-contained force magnifying hand tool 400. Self-contained force magnifying hand tool 400 includes a striker portion 405 and a tool portion 410. Spring 415 is attached to tool portion 410 by one or more spring coils 420*a* affixed to tool portion 410 by spring retainer 425*a*. Similarly, spring 415 is attached to striker portion 405 by one or more spring coils 420*b* affixed to striker portion 405 by spring retainer 425*b*. In this embodiment, spring 415 is external to striker portion 405 and tool portion 410.

Spring retainer 425*a*, as shown in FIG. 4A, is a screw which attaches one or more spring coils 420*a* to tool portion 410. Spring retainer 425*b*, as shown in FIG. 4A, is also a screw which attaches one or more spring coils 420*b* to striker portion 405. However, as discussed above with respect to FIG. 2C, spring retainers 425*a* and 425*b* are not limited to screws. Spring retainers 425*a* and 425*b* may include a pin, a tapered pin, a screw, a bolt, a rivet, a rod, or any other similar device that attaches spring 415 to tool portion 410 and striker portion 405.

In implementation, a user pulls on striker portion 405 with one hand while holding tool portion 410 with another hand, extending spring 415. When spring 415 is extended, mechanical energy is stored in spring 415. When striker portion 405 is released by the user, spring 415 returns to a compressed state, transferring the mechanical energy stored in spring 415 into a driving force as striker portion 405 impacts tool portion 410. The driving force is magnified by the blade of tool portion 410 and applied to a workpiece.

FIG. 4A further includes a bit retainer 430. In this embodiment, which is yet another example of implementations that are not specific to a particular figure, tool portion 410 is configured to receive various chisel bits, removably held in place by bit retainer 430. Bit retainer 430 is shown as a detent ball recess in FIG. 4A. However, other bit retainers may be used. Exemplary bit retainers include a c-clip, through-wedged tenon joints, pins, tapered pins, threaded pins, set screws, magnets, screws, bolts, detent balls, and any other known bit retention means. Thus, while a detent ball recess is shown to represent bit retainer 430 in FIG. 4A, the disclosure is not limited to a detent ball recess for the bit retainer 430.

Figure 4C:
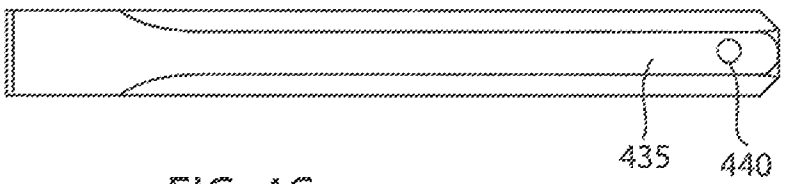
FIG. 4C illustrates a side view of a removable bit.
Figure 4B:
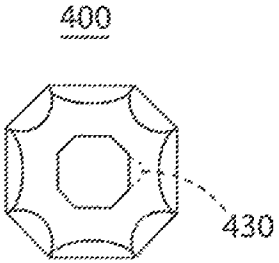
FIG. 4B illustrates a front view of the self-contained force magnifying hand tool disclosed herein.

FIG. 4B illustrates a front view of self-contained force magnifying hand tool 400 which includes a bit retainer 430, shown as a detent ball recess for purposes of explanation. However, as discussed above, bit retainer 430 is not limited to the use of a detent ball and corresponding detent ball recess.

FIG. 4C illustrates a side view of a removable exemplary chisel bit 435 which can be inserted into tool portion 410. As discussed above, particular chisels serve a particular purpose and are generally useful only for that particular purpose. Thus, by providing removable bits, the utility of self-contained force magnifying hand tool 400 is enhanced such that one self-contained force magnifying hand tool 400 is usable for multiple different applications. For example, self-contained force magnifying hand tool 400 can use a bull point bit for chiseling concrete and then change to a flat chisel bit for cleaving masonry bricks. Removable chisel bit 435 includes a bit retainer 440 corresponding to bit retainer 430 shown in FIGS. 4A and 4B. While bit retainer 440 is represented in FIG. 4C as a detent ball, other implementations are possible. For example, if a c-clip is used as bit retainer 430, bit retainer 440 in removable chisel bit 435 may include a slot cut around the removable chisel bit, into which the c-clip fits. In another example, bit retainers 430 and 440 may be holes through which a pin may be installed that holds removable chisel bit 435 into tool portion 410 of self-contained force magnifying hand tool 400. Thus, a single hand tool may be used for a plurality of applications by exchanging one bit for another.

Figure 5:
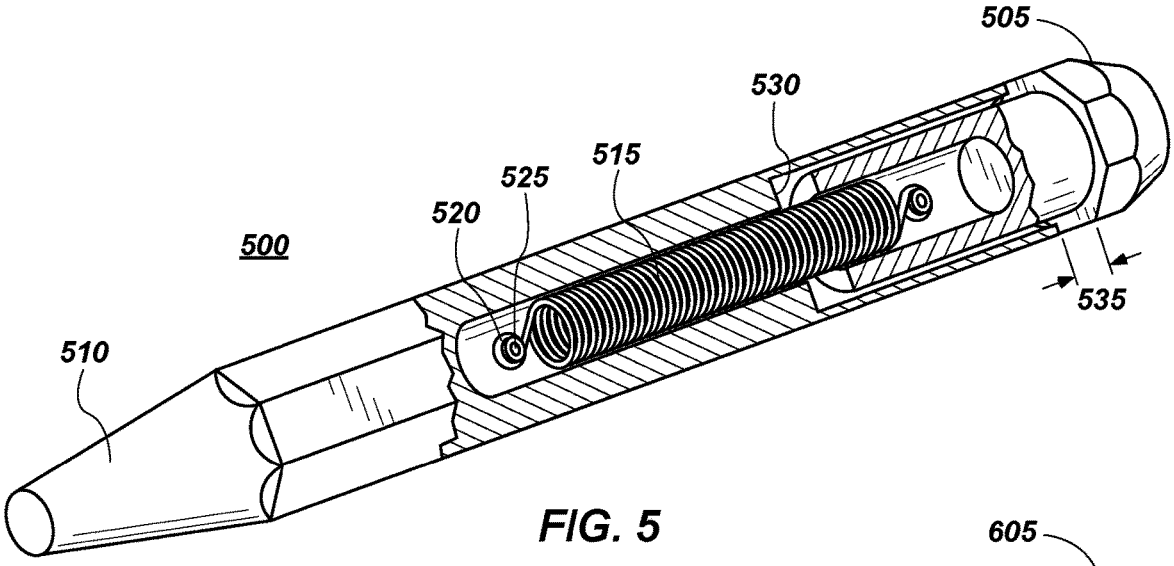
FIG. 5 illustrates a cross-sectional perspective view of a self-contained force magnifying hand tool.

FIG. 5 illustrates a cross-sectional side view of a self-contained force magnifying hand tool 500 which may be similar in implementation to FIGS. 2A-2D. Self-contained force magnifying hand tool 500 includes an internal striker 505. Self-contained force magnifying hand tool 500 includes a tool portion 510 which is machined such that an inside diameter of tool portion 510 is greater than an outside diameter of at least a portion of internal striker 505. In other words, internal striker 505, shown in FIG. 5, includes both a male end that may be disposed inside a female end of tool portion 510 and a handle which may be grasped by a user.

As discussed above, a male end of internal striker 505 is disposed within tool portion 510 and includes a handle that may be grasped by a user. Also disposed within tool portion 510 of self-contained force magnifying hand tool 500 is spring 515, which is attached to both tool portion 510 and internal striker 505. FIG. 5 does not show a spring guide tube. However, a spring guide tube, such as spring guide tube 120 discussed with respect to FIG. 1A may be included in some embodiments. Rather, in FIG. 5, tool portion 510 has been machined such that spring 515 may be disposed within tool portion 510. Thus, the internal portion of tool portion 510 may act as a spring guide tube, guiding spring 515 as it is extended and compressed. Spring 515 may be configured such that one or more spring coils 520 on each end of spring 515 are bent to be substantially perpendicular to the rest of spring 515. The term substantially perpendicular means that one or more spring coils 520 are bent such that a spring retainer 525 may be disposed in tool portion 510 and through one or more spring coils 520 of spring 515. Spring 515 may therefore be attached to tool portion 510 by spring retainer 525.

Spring retainer 525 may include a pin, a tapered pin, a screw, a bolt, a rivet, a rod, or any other similar device. In one embodiment, a pin, acting as spring retainer 525 may be inserted through a hole, corresponding in size to the pin, in tool portion 510 through one or more spring coils 520, and into another hole in tool portion 510. Thus, the pin is supported on two sides by holes in tool portion 510 and travels through one or more spring coils 520 in order to attach spring 515 to tool portion 510.

A second spring retainer 525 may be installed in internal striker 505 to attach spring 515 to internal striker 505 in the same manner that spring retainer 525 is installed on tool portion 510. For example, spring 515 may have one or more spring coils 520 bent such that one or more spring coils 520 are substantially perpendicular to spring 515. The term substantially perpendicular means that one or more spring coils 520 are bent such that spring retainer 525 may be disposed in internal striker 505 and through one or more spring coils 520 of spring 515. Spring 515 may also be disposed within internal striker 505. Further, a second spring retainer 525 may be inserted through holes in internal striker 505 and through one or more spring coils 520. Thus, spring 515 is attached to both tool portion 510 and internal striker 505.

Once spring 515 is attached to both tool portion 510 and internal striker 505, spring 515 pulls tool portion 510 and internal striker 505 together. In order to create an impact point between internal striker 505 and tool portion 510, tool portion 510 further includes impact shoulders 530. Impact shoulders 530 receive blows from internal striker 505 when spring 515 is extended and released. Thus, as shown in FIG. 5, the inside of tool portion 510 is configured such that spring 515 may be disposed within tool portion 510 and, in some embodiments, act as a guide for spring 515, while also providing impact shoulders 530 that are struck by internal striker 505. FIG. 5 shows spring 515 in a slightly extended state. When spring 515 is in a compressed state, internal striker 505 rests on impact shoulders 530 within tool portion 510.

In operation, a user pulls on internal striker 505 with one hand while holding tool portion 510 in another hand, extending spring 515. The extension of spring 515, which is retained by a spring retainer 525 in both tool portion 510 and internal striker 505, creates mechanical energy in spring 515. When the user releases internal striker 505, the mechanical energy in spring 515 is released, driving internal striker 505 into impact shoulders 530 of tool portion 510. The driving force created when internal striker 505 impacts shoulders 530 of tool portion 510 is magnified by a chisel blade on tool portion 510 of self-contained force magnifying hand tool 500. In order to prevent pinching of the user's hands, gap 535 is created between the handle of internal striker 505 and tool portion 510. The length of the male end of internal striker 505 may be adjusted such that the handle of internal striker 505 does not impact tool portion 510. Rather, the impact of the internal striker 505 is applied only to tool portion 510 through impact shoulders 530. The length of the male end of internal striker 505 is configured to prevent internal striker 505 from being removed from the female end of tool portion 510 during extension of spring 515.

Finally, as shown in FIG. 5, self-contained force magnifying hand tool 500 is implemented as a punch for explanatory purposes. However, self-contained force magnifying hand tool 500 may be implemented as any striking tool. For example, instead of a narrow cylindrical punch terminating tool portion 510, self-contained force magnifying hand tool 500 may be implemented with a wider end that serves as a hammer. Alternatively, self-contained force magnifying hand tool 500 may include a narrow and tapered end that serves as a nail set or an awl. Self-contained force magnifying hand tool 500 may be implemented with any tool end that may suit a particular purpose, including those tools and purposes known to the art.

Figure 6A:
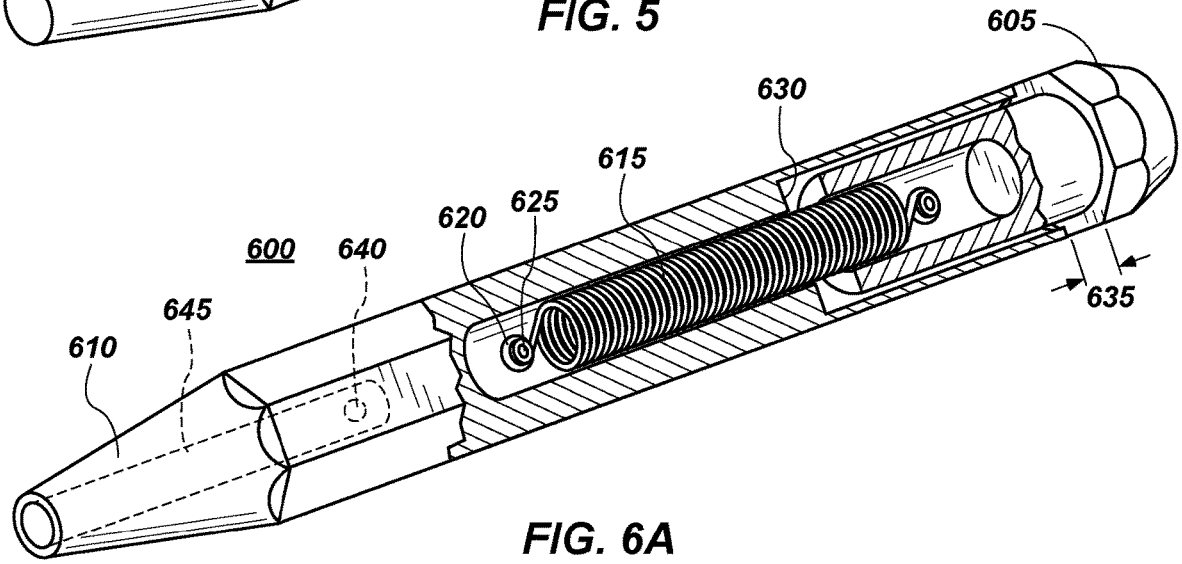
FIG. 6A illustrates a perspective view of an exemplary implementation of a self-contained force magnifying hand tool using removable bits.

FIG. 6A illustrates an exemplary implementation of a self-contained force magnifying hand tool 600 using removable bits. Self-contained force magnifying hand tool 600 may be implemented in a manner that is similar to self-contained magnifying hand tool 500, shown in FIG. 5. Thus, self-contained force magnifying hand tool 600 further includes internal striker 605, tool portion 610, spring 615, spring coils 620, spring retainers 625, impact shoulders 630, and gap 635. However, self-contained magnifying hand tool 600 also includes a bit retainer 640 within a bit recess 645. In this embodiment, which is yet another example of implementations that are not specific to a particular figure, tool portion 610 is configured to receive various chisel bits, removably held in place by bit retainer 640. Bit retainer 640 is shown as a detent ball recess in FIG. 6A. However, other bit retainers may be used. Exemplary bit retainers include a c-clip, through-wedged tenon joints, pins, tapered pins, threaded pins, set screws, magnets, screws, bolts, detent balls, and any other known bit retention means. Thus, while a detent ball recess is shown to represent bit retainer 640 in FIG. 6A, the disclosure is not limited to a detent ball recess for the bit retainer 640.

Figure 6B:
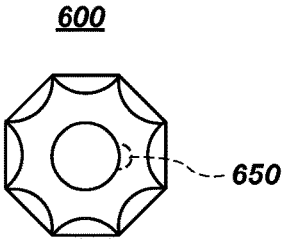
FIG. 6B illustrates a front view of the self-contained force magnifying hand tool disclosed herein.

FIG. 6B illustrates a front view of the self-contained force magnifying hand tool 600 which includes a bit retainer 650, shown as a detent ball recess for purposes of explanation. However, as discussed above, bit retainer 650 is not limited to the use of a detent ball and corresponding detent ball recess.

Figure 6C:
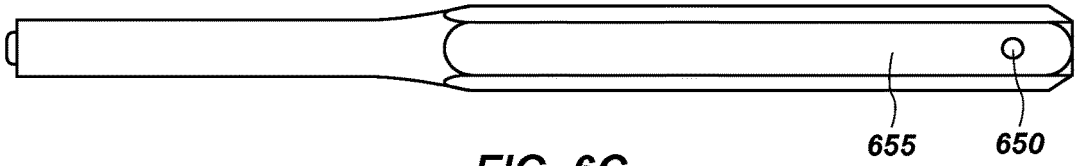
FIG. 6C illustrates a side view of a removable bit for the self-contained force magnifying hand tool disclosed herein.

FIG. 6C illustrates a side view of a removable bit for the self-contained force magnifying hand tool 600 which includes removable tool bit 655 which can be inserted into recess 645 within tool portion 610. By providing removable bits, the utility of self-contained force magnifying hand tool 600 is enhanced such that one self-contained force magnifying hand tool 600 is usable for multiple different applications. For example, self-contained force magnifying hand tool 600 may be used as a punch to remove roll pins from firearms or other devices. By changing removable tool bit 655 from a roll pin bit to a hammer bit, self-contained force magnifying hand tool 600 may become a hammer or another striking tool Removable tool bit 655 includes a bit retainer 650 corresponding to bit retainer 640 shown in FIGS. 6A and 6B. While bit retainer 650 is represented in FIG. 6C as a detent ball, other implementations are possible. For example, if a c-clip is used as bit retainer 650, bit retainer 650 in removable tool bit 655 may include a slot cut around the removable chisel bit, into which the c-clip fits. In another example, bit retainer 650 may be holes through which a pin may be installed that holds removable tool bit 655 into recess 645 of tool portion 610 of self-contained force magnifying hand tool 600. Thus, a single hand tool may be used for a plurality of applications by exchanging one bit for another.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A tool comprising:

a tool portion including impact shoulders disposed within the tool portion, a striker, at least a portion of which is disposed within the tool portion, and a spring, at least a portion of which is disposed within the tool portion and at least a portion of which is disposed within the striker, and which is attached to the tool portion and to the striker, wherein the striker, disposed within the tool portion, impacts the tool portion on the impact shoulders disposed within the tool portion.

2. The tool of claim 1, further comprising:

a spring guide tube.

3. The tool of claim 2, wherein the spring is disposed inside the spring guide tube.

4. The tool of claim 1, further comprising a spring retainer attaching the spring to the tool portion.

5. The tool of claim 1, wherein the tool portion includes a hammer.

6. The tool of claim 1, wherein the tool portion includes a punch.

7. The tool of claim 1, wherein the tool portion receives removable chisel bits.

8. The tool of claim 7, wherein the tool portion further includes a bit retainer.

9. The tool of claim 1, wherein a gap is provided between a handle portion of the striker and the tool portion when the spring is in a compressed state.

10. A method of making a tool, comprising:

disposing a spring within a tool portion of the tool, the tool portion of the tool including impact shoulders disposed within the tool portion of the tool, attaching the spring to the tool portion of the tool within the tool portion, and disposing, within the tool portion of the tool, a striker, the spring being disposed within the striker and the spring being attached to the striker at a point within the striker, the striker being disposed in the tool portion of the tool to impact the tool portion on the impact shoulders disposed within the tool portion of the tool.

11. The method of claim 10, further comprising providing a spring retainer for attaching the spring to the tool portion.

12. The method of claim 11, further comprising providing the spring retainer with threads.

13. The method of claim 12, further comprising providing the spring with one or more spring coils through which the spring retainer is inserted.

14. The method of claim 10, further comprising, disposing, on the tool portion of the tool, a punch.

15. The method of claim 10, further comprising, disposing, on the tool portion of the tool, a hammer.

16. The method of claim 10, further comprising, disposing, on the tool portion of the tool, a striking hand tool.

17. A tool kit, comprising:

a tool portion including impact shoulders disposed within the tool portion;

a striker, at least a portion of which is disposed within the tool portion;

a spring, at least a portion of which is disposed within the tool portion and at least a portion of which is disposed within the striker, and which is attached to the tool portion and to the striker, wherein the striker, disposed within the tool portion, impacts the tool portion on the impact shoulders disposed within the tool portion; and one or more tool bits releasably attached to the tool portion.

18. The tool kit of claim 17, wherein the one or more tool bits include one or more punches.

19. The tool kit of claim 17, wherein the one or more tool bits include one or more hammers.

20. The tool kit of claim 17, wherein the one or more tool bits include one or more chisels.

* * * * *